US005284342A

United States Patent [19]

Tanzer et al.

[11] Patent Number: 5,284,342

[45] Date of Patent: Feb. 8, 1994

[54] PINBALL MACHINE HAVING A SYSTEM CONTROLLED ROTATING FLIPPER

[75] Inventors: Raymond C. Tanzer, Naperville; Marian Czyz, Niles, both of Ill.

[73] Assignee: Premier Technology, Bensenville, Ill.

[21] Appl. No.: 372

[22] Filed: Jan. 4, 1993

[51] Int. Cl.[5] ..... A63B 71/00

[52] U.S. Cl. ..... 273/121 A; 273/127 R; 273/129 V

[58] Field of Search ..... 273/118 R, 118 A, 118 D, 273/119 R, 119 A, 119 B, 120 R, 120 A, 121 R, 121 A, 122 R:122 A, 123 R, 123 A, 124 R, 124 A, 125 R, 125 A, 129 R, 129 V, 129 W

[56] References Cited

U.S. PATENT DOCUMENTS

| | | | |
|---|---|---|---|
| 3,578,802 | 5/1971 | Murphy et al. . | |
| 4,009,475 | 2/1977 | DeFreitas . | |
| 4,136,871 | 1/1979 | Meyers et al. | 273/129 V X |
| 4,189,150 | 2/1980 | Langieri | 273/129 W X |
| 4,244,575 | 1/1981 | Hori . | |
| 4,354,681 | 10/1982 | Garbark . | |
| 4,426,081 | 1/1984 | Fainzilberg . | |
| 4,429,876 | 2/1984 | Halliburton et al. . | |
| 4,508,343 | 4/1985 | Peters et al. . | |
| 4,620,706 | 11/1986 | Ijidakinro . | |
| 4,773,646 | 9/1988 | Joos, Jr. et al. . | |
| 4,934,699 | 6/1990 | Kaminkow et al. . | |
| 4,892,309 | 1/1990 | Kim et al. . | |
| 4,968,031 | 11/1990 | Kaminkow et al. . | |
| 4,971,323 | 11/1990 | Gottlieb | 273/129 V |
| 4,971,324 | 11/1990 | Grabel | 273/129 V |
| 4,981,298 | 1/1991 | Lawlor et al. . | |
| 5,112,049 | 5/1992 | Borg . | |
| 5,131,654 | 7/1992 | Gottlieb et al. | 273/129 V X |
| 5,158,292 | 10/1992 | Hanchar . | |
| 5,186,462 | 2/1993 | Biagi et al. | 273/129 V X |

FOREIGN PATENT DOCUMENTS

| | | |
|---|---|---|
| 2902749 | 1/1979 | Fed. Rep. of Germany . |
| 3340558 | 5/1985 | Fed. Rep. of Germany . |

OTHER PUBLICATIONS

Charles K. Taft, "Stepping Motor," McGraw-Hill Encyclopedia of Science and Technology, vol. 17 (1992), pp. 417–420.

S. A. Nasar, "Motor," McGraw-Hill Encyclopedia of Science and Technology, vol. 11 (1992), U.S., pp. 440–450.

"Transistor Thryistor & Diode Manual," RCA, Sommerville, N.J. (1971), pp. 203–227.

Pictures of five (5) Gottlieb & Co. Games: "Four Seasons" (Oct. 1968), Skipper (Aug. 1969), Road Race (Oct. 1969), Stock Car (Oct. 1969), and Roller Coaster (Jul. 1971).

*Primary Examiner*—Jessica J. Harrison
*Assistant Examiner*—Raleigh W. Chiu
*Attorney, Agent, or Firm*—Arnold, White & Durkee

[57] ABSTRACT

A flipper in a pinball machine is rotated by a motor, permitting control of the angular position or velocity of the flipper by the pinball machine in response to player input, ball position or game sequences. The flipper is controlled internally through software of the microcomputer that keeps track of game sequences and the player's score, or externally via a switch or control manipulated by the player. Preferably the angular position of the flipper is sensed, and the motor can rotate the flipper in both a clockwise and a counter-clockwise direction. In one embodiment, the flipper is rotated by more than 360 degrees to intermittently permit a timing shot when passage of the ball is synchronized to the rotation of the flipper. For example, the flipper may intermittently open a path for a ball to a target, or may intermittently permit the ball to be deflected by the flipper to a target. In either case, a player's attention is captivated by turning the motor on and off at different times in a game sequence, and permitting the player to have a degree of control over the angular velocity of the flipper. In another embodiment, the flipper is both rotated by a motor and pivoted by a solenoid, the player adjusts a control to select the angular position of the flipper, and the player activates a switch to actuate the solenoid.

23 Claims, 10 Drawing Sheets

PINBALL MACHINE HAVING A SYSTEM CONTROLLED ROTATING FLIPPER

BACKGROUND OF THE INVENTION

1. Field of the Invention

The present invention relates generally to pinball machines, and more particularly to flippers for pinball machines. The present invention specifically relates to a flipper that is rotated by a motor, permitting control of the angular position or velocity of the flipper by the pinball machine in response to player input, ball position or game sequences.

2. Background Art

In a pinball game, a player operates flippers to direct a ball over a playfield to various targets to score points. The targets are assigned different scores, and targets having high scores are often placed in areas of the playfield that are reached only by the more skillful players. The player, for example, must direct the ball to a restricted channel on the playfield to reach the high-scoring targets. The flippers are typically pivoted by solenoids to strike the ball. Typically one or more flippers that pivot in a clockwise direction are mounted at lower right peripheral positions of the playfield, and one or more flippers that pivot in a counter-clockwise direction are mounted at lower left peripheral positions of the playfield. The flippers on the right side of the playfield are activated by a player-operated push-button on the right side of the game housing, and the flippers on the left side of the playfield are activated by a player-operated push-button on the left side of the game housing.

SUMMARY OF THE INVENTION

The present invention provides a pinball machine having a flipper in which the angular position or angular velocity of the flipper is controlled by the pinball machine.

In accordance with a first embodiment of the invention, the flipper is rotated continuously to intermittently define a predetermined path for a ball to a predefined region of the playfield and to deflect the ball from the predefined region of the playfield unless passage of the ball is synchronized to the rotation of the flipper. The flipper, for example, opens and closes a predefined path for passage of a ball over the playfield to the predefined region, or deflects the ball into the predefined region, and otherwise deflects the ball away from the predefined region.

In accordance with a second embodiment of the invention, the angular position or angular velocity of the flipper is adjusted in response to a control manipulated by the player, such as a foot pedal or a rotary knob.

In accordance with a third embodiment of the invention, the angular position of the flipper is adjusted in response to an angular position sensor such as a switch or rotary control sensing the angular position of the flipper.

In accordance with a fourth embodiment of the invention, the angular velocity or direction of rotation of the flipper is controlled by a microcomputer in response to game sequences.

In accordance with a fifth embodiment of the invention, the flipper is both rotated by a motor and pivoted by a solenoid, the player manipulates a control to adjust the angular position of the flipper, and the player activates a switch to pivot the flipper.

The present invention enhances the ability of the player to control the ball during play, and enhances the ability of the pinball machine to adjust the difficulty of play to satisfy a wide variety of players. Therefore the present invention can be applied to a wide variety of playfield configurations and game themes to captivate the player's interest and attention.

BRIEF DESCRIPTION OF THE DRAWINGS

Other objects and advantages of the invention will become apparent upon reading the following detailed description with reference to the accompanying drawings wherein.

Figure 1:
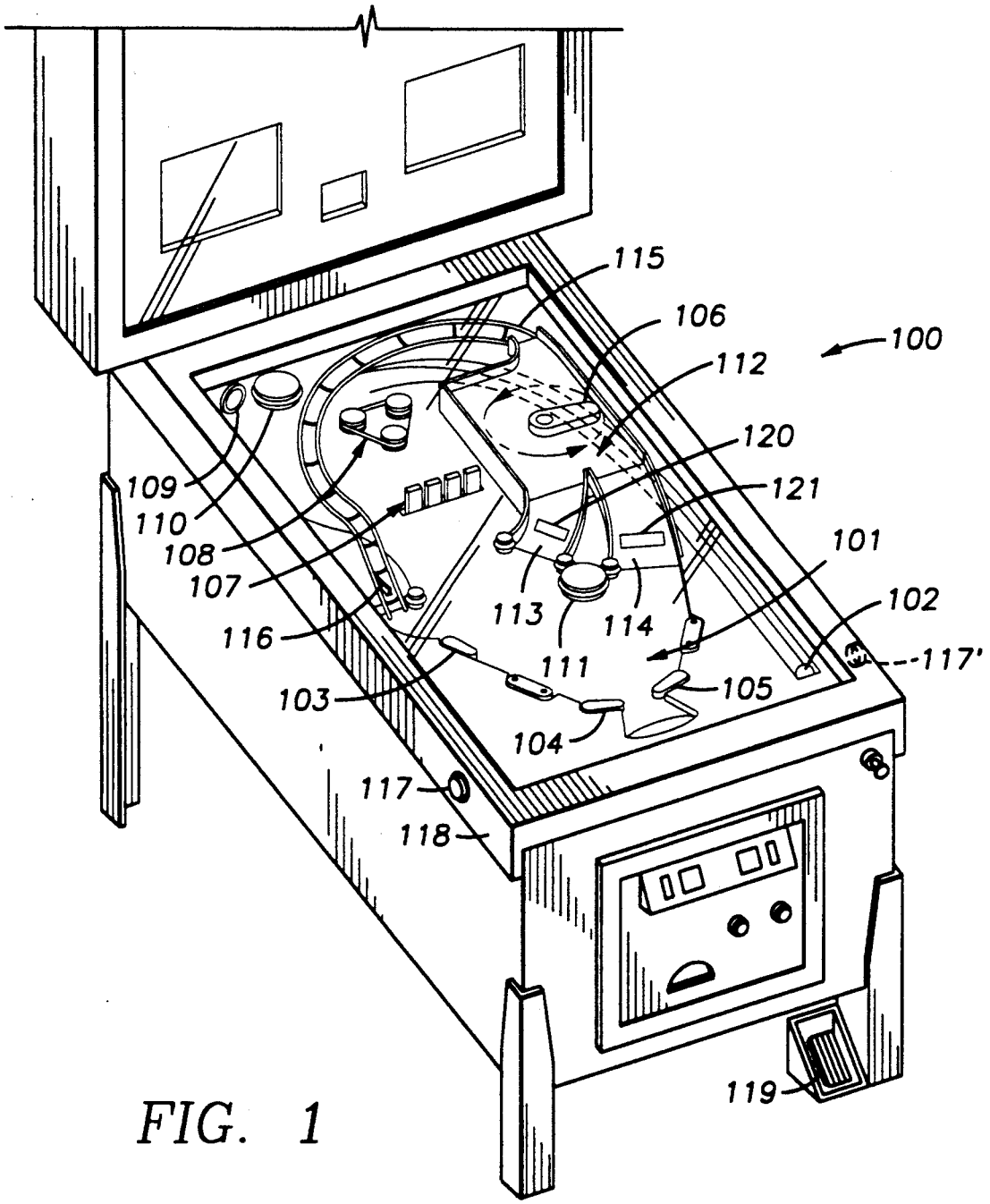
FIG. 1 is a perspective view of a pinball machine incorporating the present invention.

While the invention is susceptible to various modifications and alternative forms, a specific embodiment thereof has been shown in the drawings and will be described in detail. It should be understood, however, that it is not intended to limit the invention to the particular form shown, but on the contrary, the intention is to cover all modifications, equivalents, and alternatives falling within the scope of the invention as defined by the appended claims.

DETAILED DESCRIPTION OF THE PREFERRED EMBODIMENT

Turning now to FIG. 1 of the drawings, there is shown a pinball machine 100 employing the present invention. The pinball machine 100 has a playfield 101 over which a ball 102 travels under the influence of a player (not shown). During play, the ball 102 strikes a number of flippers 103, 104, 105, and targets 107, 108, 109, 110, 111. Dependinq upon the state of the game, the impact of the ball 102 upon a target causes the players, score to be increased (or possibly decreased) by a certain number of points. The targets 107, known as drop targets, may respond to impact with the ball 102 by dropping underneath the playfield 101. The targets 108, 110, 111, known as bumper targets, may respond to impact with the ball 102 by energizing a solenoid (not shown) to cause the ball to be ejected from the target at an increased velocity.

In the game 100 shown in FIG. 1, the playfield has an elevated playfield section 112 accessible by left and right vacuum-formed plastic ramps 113, 114. At the upper right of the elevated playfield section 112, there is an entrance to a wire ramp 115 for returning the ball 102 back to the left flippers 103, 104. At the exit of the wire ramp 115, there is a switch 116 that will signal a high score when the ball 102 exits the wire ramp. Therefore, the player is induced to actuate the flipper 104, by activating a flipper button 117 in the left side of the game housing 118, so as to project the ball 102 up the ramp 114 into the elevated playfield section 112. In a conventional manner, the flipper button 117 actuates the flippers 103 and 104 on the left side of the playfield 101, and a flipper button 117' actuates the flipper 105 on the right side of the playfield.

In order to make the game more difficult for advanced players, the path to the entrance of the wire ramp 115 is intermittently blocked by clockwise rotation of the flipper 106. If the ball is not shot up the right ramp 114 at the proper time, the flipper will strike the ball and send it back down the right ramp 114 or the left ramp 113. The flipper 106 almost always blocks the path from the left ramp 113 to the entrance of the wire ramp.

To make the game interesting to all players, the flipper 106 is initially placed in a predetermined angular position so as to provide a completely open path from the right ramp 114 to the entrance of the wire ramp 115. But when the ball 102 first traverses the wire ramp 115 and is sensed by the switch 116 at the exit of the wire ramp, the flipper 106 begins rotating at a constant speed predetermined so that the flipper will block the path from the ramp 114 to the entrance of the wire ramp 115 when the ball rolls from the switch 116 to the flipper 104. The player, however, can adjust a foot pedal 119 to increase the speed of the flipper 106 so that the path from the right ramp 114 to the entrance of the wire ramp 115 will be open when the ball reaches the flipper 104.

Player interest is further captivated by an appropriate game theme. The circulation of the ball through the wire ramp, the blocking of the entrance to the wire ramp, and the player's operation of the foot pedal, for example, suggests that a "race car" theme would be appropriate for the game. As will be further described below, however, a rotating flipper can be controlled in a variety of ways in accordance with various aspects of the present invention, so that the present invention is not limited to any particular playfield organization or game theme.

The pinball machine 100 is an example of a game in which the flipper 106 is rotated continuously to intermittently define a predetermined path for a ball to a predefined region of the playfield and to deflect the ball from the predefined region of the playfield unless passage of the ball is synchronized to the rotation of the flipper. In particular, the flipper 106 opens and closes a predefined path from the right ramp 114 to the wire ramp. Alternatively, the game sequence could award the player points when the flipper 106 deflects the ball into the predefined region, and otherwise deflects the ball away from the predefined region. In the pinball machine 100, for example, the left ramp 113 has a switch 120 or proximity sensor for sensing the passage of the ball 102 through the left ramp 113, and the right ramp 114 has a switch 121 or proximity sensor for sensing the passage of the ball 114. The player is awarded a high score if the ball 102 is shot up into the left ramp 113 and immediately deflected by the flipper 106 down into the right ramp 114. A microcomputer (not shown) that typically is used to keep track of the player's score detects such a successful "bank shot" by checking whether the ball 102 is sensed by the switch 114 in the right ramp 114 within a predetermined period of time after the ball 102 is sensed in the left ramp 113. In other words, when the ball passes through the left ramp 113, the microcomputer begins inspecting the switch 121 for a predetermined period of time and awards the player the high score if the switch 121 detects the ball within the predetermined period of time.

Figure 2:
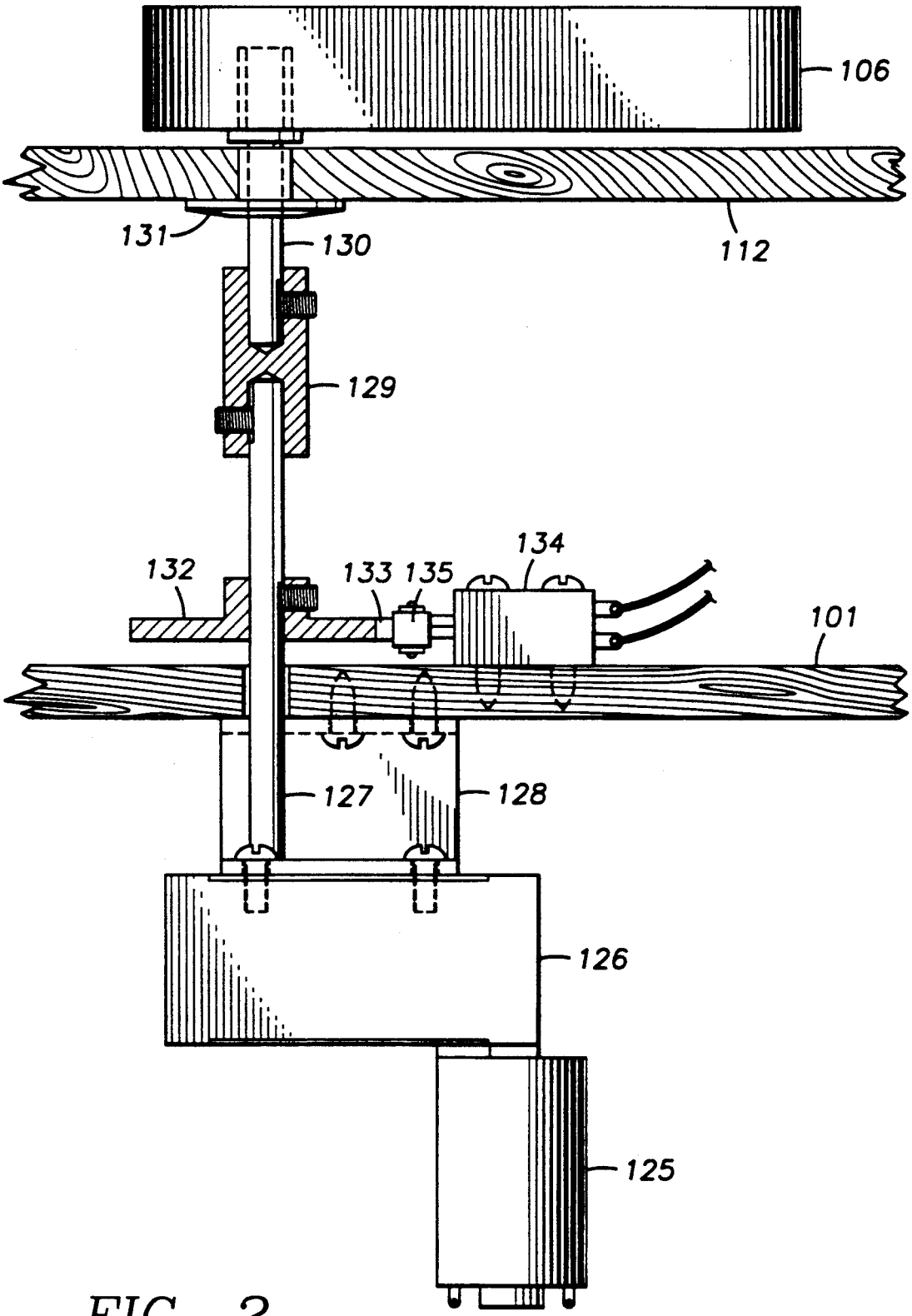
FIG. 2 is an elevation view, in partial section, showing the motor and the mechanical linkage used for rotating a flipper in the pinball machine of FIG. 1.

Turning now to FIG. 2, there is shown a motor 125 and a mechanical linkage for continuously rotating the flipper 106 by more than 360°. The motor 125 is coupled by a reducing gear box 126 to a shaft 127. The gear box 126 is mounted by a bracket 128 to the main playfield 101 so that the shaft 127 protrudes above the main playfield 101. The shaft 127 is coupled via a coupler 129 to a shaft 130 of the flipper 106. The shaft 130 of the flipper 106 extends downward through a bushing 131 press-fitted into the upper playfield section 112.

For sensing the angular position of the flipper 106, a rotary cam 132 is mounted to the shaft 127. The rotary cam 132 has a circular periphery except for a flat 133. A switch 134 has a roller 135 that follows the outer periphery of the cam 132. When the roller 135 rolls over the flat 133, the switch 134 opens, thereby signaling a predefined angular position of the flipper 106.

Figure 3:
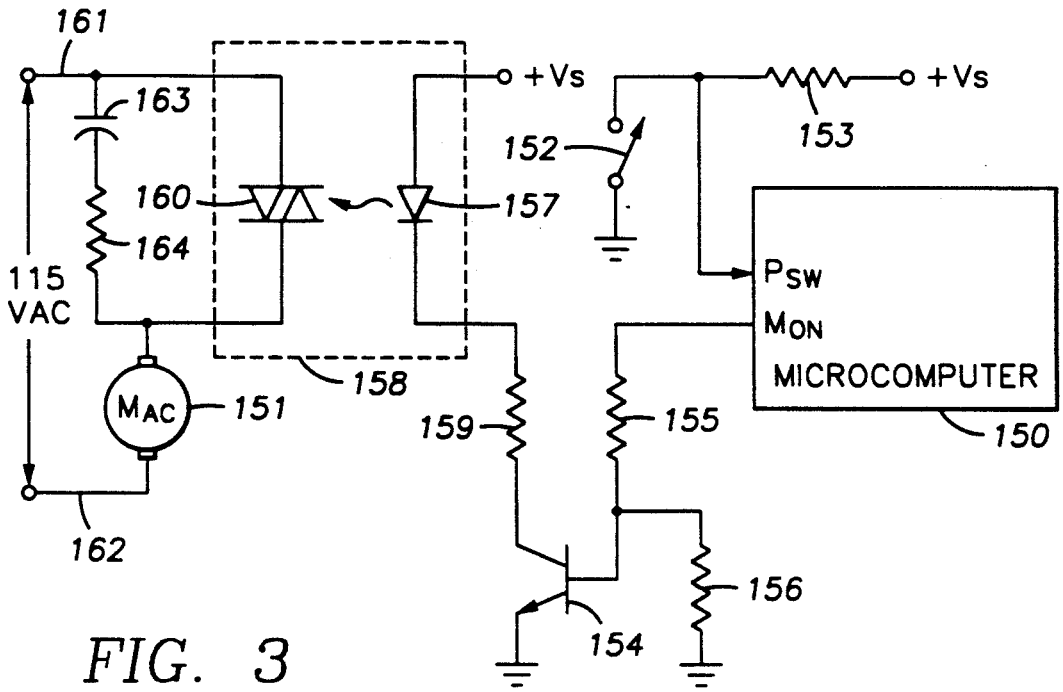
FIG. 3 is a schematic diagram of a circuit for controlling an AC motor which could be used for rotating the flipper shown in FIGS. 1 and 2.

Turning now to FIG. 3, there is shown a schematic diagram of a circuit for permitting a microcomputer 150 to control an AC motor 151 that could, for example, be the motor 125 in FIG. 2. The microcomputer 150 is responsive to numerous switches, such as a switch 152 which could be the switch 134 in FIG. 2. The switch 152 closes a path from ground to a pull-up resistor 153 connected to a positive supply voltage +Vs. Therefore, the opening and closing of the switch 152 generates a logic signal (Psw) indicating, for example, the position of a flipper (not shown) rotated by the motor 151.

In order to turn on the motor 151, the microcomputer asserts a logic signal (Mon). The logic signal is applied to the base of a transistor 154 through a series resistor 155 and a shunt resistor 156 to ground. The resistors 155 and 156, for example, each have a value of 10K ohms. When the signal Mon is asserted, the transistor 154 turns on and closes a circuit through a light-emitting diode 157 of a solid-state relay 158. A series resistor 159, for example, 470 ohms, limits the flow of current through the diode 157. The solid-state relay 158 includes a light-activated triac 160 that connects the motor 151 to AC power lines 161 and 162. To prevent noise on the power lines 161, 162 from triggering the triac 160, the triac is shunted by a snubber network including a capacitor 163 and a resistor 164. The capacitor 163, for example, has a value of 0.01 microfarads, and the resistor 164 has a value of 47 ohms.

The circuit in FIG. 3 can operate the motor 151 at a constant maximum speed and can pulse the motor at intervals to operate the motor 151 at lower speeds.

For operating the pinball machine 100 as shown and described above with respect to FIG. 1, the speed of the motor 125 of FIG. 2 preferably is regulated in a uniform manner. Various means are known for regulating the speed of a motor in a uniform manner, such rheostats, linear amplifiers, thyristor firing angle controls, and digital techniques such as pulse-width modulation and delta-sigma modulation. When an instantaneous power level of about ten watts or more is desired for rapidly changing the rate of rotation of the flipper, the digital techniques are preferred. The digital techniques limit the power dissipation of the active components regulating the flow of current through the motor, and provide an easy way of controlling the motor by digital signals from a microcomputer.

Figure 4:
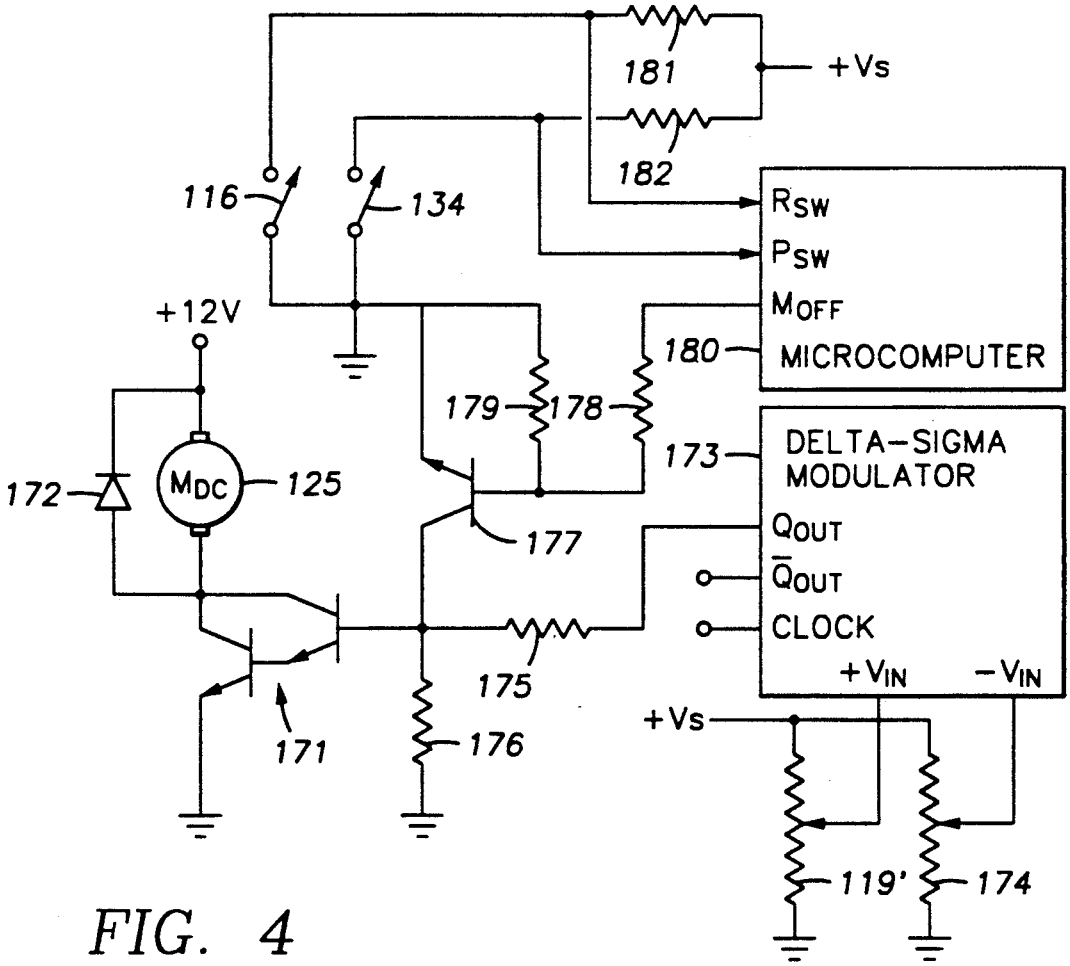
FIG. 4 is a schematic diagram of a circuit for controlling a DC motor which could be used for rotating the flipper shown in FIGS. 1 and 2.

As shown in FIG. 4, the motor 125 is a 12-volt motor driven by a Darlington transistor pair generally designated 171. A directional diode 172 is placed across the terminals of the motor 125 to suppress switching transients. To reduce power dissipation in the transistors 171, the transistors are switched on and off by a binary signal at a high rate of about 10 kilohertz. The binary signal is generated by a delta-sigma modulator 173 responsive to an analog control voltage from a potentiometer 119' in the foot pedal 119 of FIG. 1. The delta-sigma modulator 173 is also responsive to a bias voltage from a potentiometer 174 which is adjusted to set a minimum speed of rotation of the flipper 106 in FIG. 1. The delta-sigma modulator 173 is coupled to the Darlington transistors 171 by a series resistor 175 and a shunt resistor 176 to ground. The resistors 175, 176, for example, have a value of 10K ohms.

For the operation of the game 100 as described above with respect to FIG. 1, the motor 125 is also controlled in response to the ramp switch 116 introduced in FIG. 1, and the position sensing switch 134 in FIG. 2. These switches are sensed by a microcomputer 180 which is typically used to keep track of the player's score. The switches 116, 134 are connected between ground and respective pull-up resistors 181, 182, to supply logic signals (Rsw and Psw) to the microcomputer 180. The microcomputer generates a motor control signal (Moff) which is asserted to turn off the motor 125. The signal Moff is applied to a transistor 177 through a series resistor 178 and a shunt resistor 179. The resistors 178, 179, for example, each have a value of 10K ohms. When the signal Moff is asserted, the transistor 177 shunts the input to the transistors 171 to ground, thereby turning off the motor 125.

Figure 5:
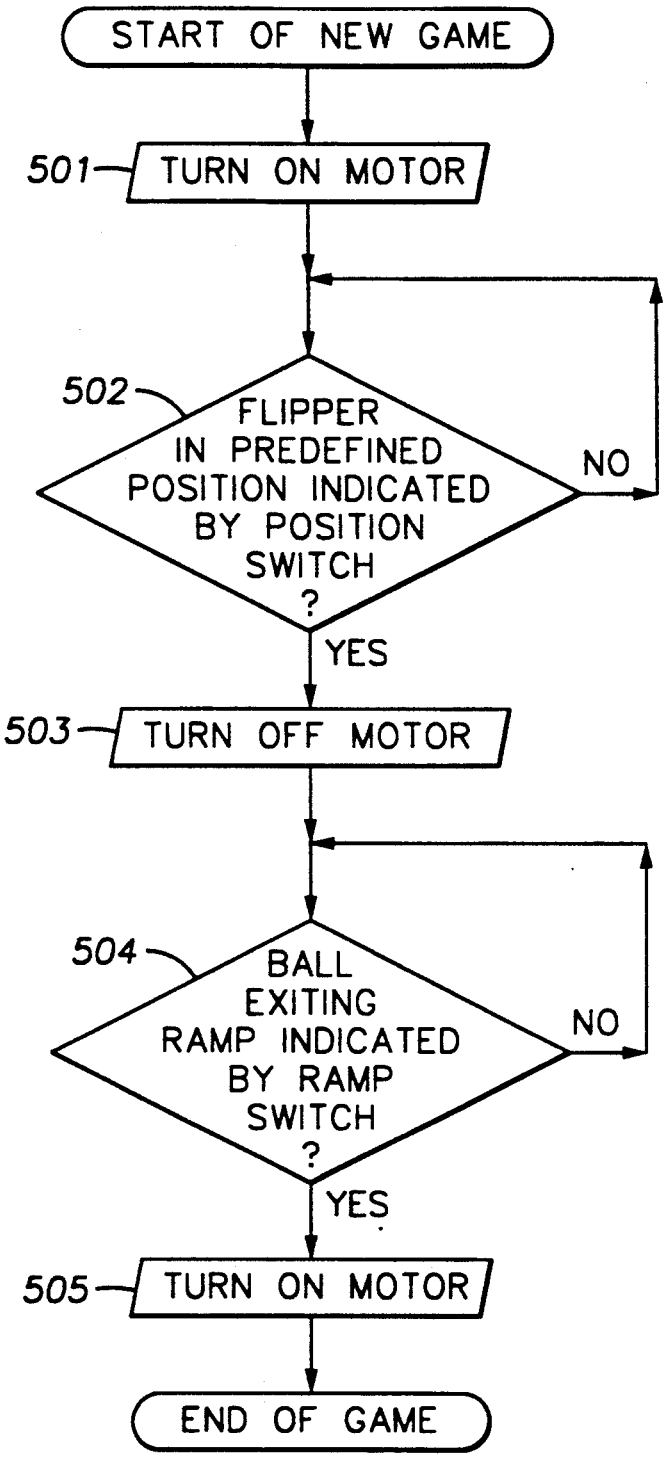
FIG. 5 is a flowchart of a control program executed by a microcomputer to control the pinball machine of FIG. 1 in accordance with a predefined game sequence.

Turning now to FIG. 5, there is shown a flowchart of the procedure programmed into the microcomputer 180 in FIG. 4 to control the pinball game 100 as described above with respect to FIG. 1. In the first step 501 of FIG. 5, the microcomputer 180 in FIG. 4 turns on the motor (125 in FIG. 4) by de-asserting the signal Moff at the start of a game, so that the flipper (106 in FIG. 1) begins rotating. Next, in step 502, the microcomputer (180 in FIG. 4) samples the signal Psw until the signal Psw is a logic high, indicating that the flipper (106 in FIG. 1) has rotated to the predefined angular position indicated by the position switch (152 in FIG. 4). Then in step 503, the microcomputer (180 in FIG. 4) turns off the motor (125 in FIG. 4) by asserting the signal Moff so that the flipper (106 in FIG. 1) stops rotating. In step 504, the microcomputer (180 in FIG. 4) samples the signal Rsw from the ramp switch (116 in FIG. 1) until the ramp switch indicates that the ball is exiting the wire ramp (115 in FIG. 1). Then, in step 505, the microcomputer (180 in FIG. 4) turns on the motor (125 in FIG. 4) by de-asserting the signal Moff.

Figure 6:
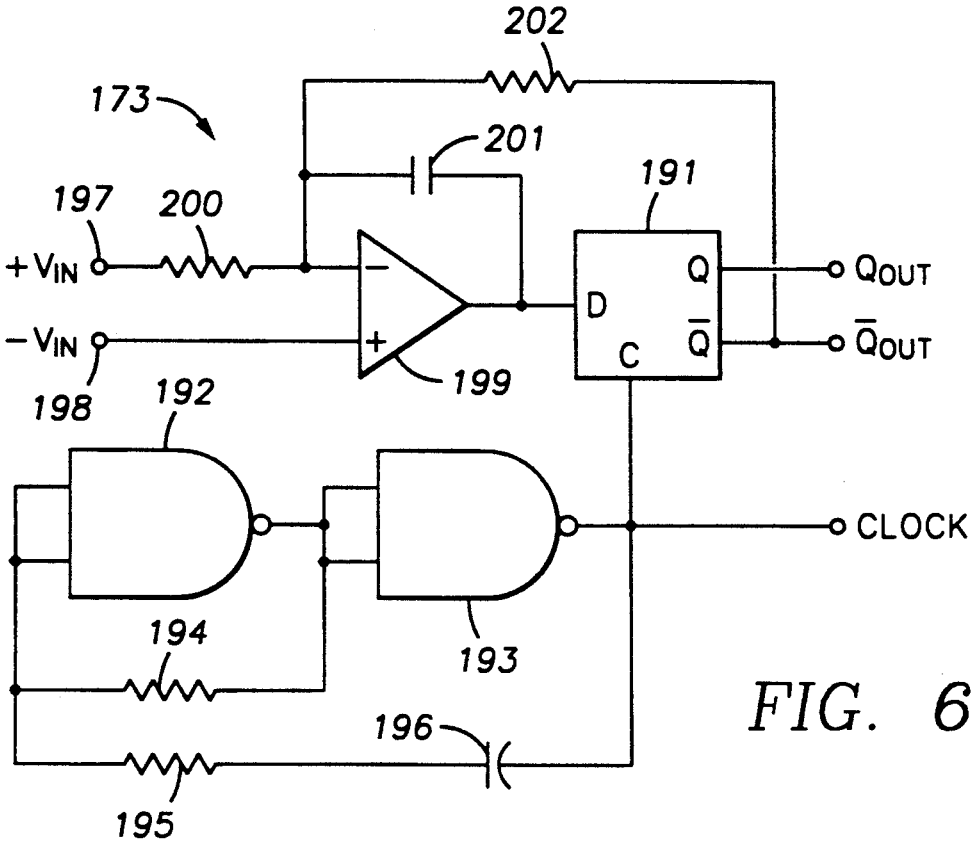
FIG. 6 is a schematic diagram of a delta-sigma modulator used in the schematic diagram of FIG. 4.

Turning now to FIG. 6, there is shown a schematic diagram of the delta-sigma modulator 173 introduced in FIG. 4. The output of the delta-sigma modulator is provided by a D flip-flop 191 that is clocked at a rate of about 10 kilohertz supplied by an oscillator including two NAND gates 192, 193. The D flip-flop 191, for example, is part number 4013, and the NAND gates 192, 193 are part number 4011. A resistor 194 connects the output of the gate 192 to the input of the gate 192. The output of the gate 193 is connected to the input of the gate 192 by a resistor 195 in series with a capacitor 196. The resistors 194, 195, for example, each have a value of 10K ohms, and the capacitor 196 has a value of 0.01 microfarad.

The D flip-flop 191 generates a binary signal having an average value responsive to the difference between the voltage between a positive input terminal 197 and a negative input terminal 198. The positive input terminal 197 is connected to the negative input of an operational amplifier 199 through a series resistor 200. The negative input terminal 198 is connected to the positive input terminal of the operational amplifier 199. A capacitor 201 is connected from the output of the operational amplifier 199 to the negative input of the operational amplifier. The output of the operational amplifier 199 is connected to the D input of the D flip-flop 191. The Q output, asserted low, of the flip-flop is connected to the negative input of the operational amplifier 199 through a feedback resistor 202. The resistor 197, for example, has a value of 68K ohms, the resistor 202 has a value of 100K ohms, and the capacitor 201 has a value of 0.1 microfarads.

Figure 7:
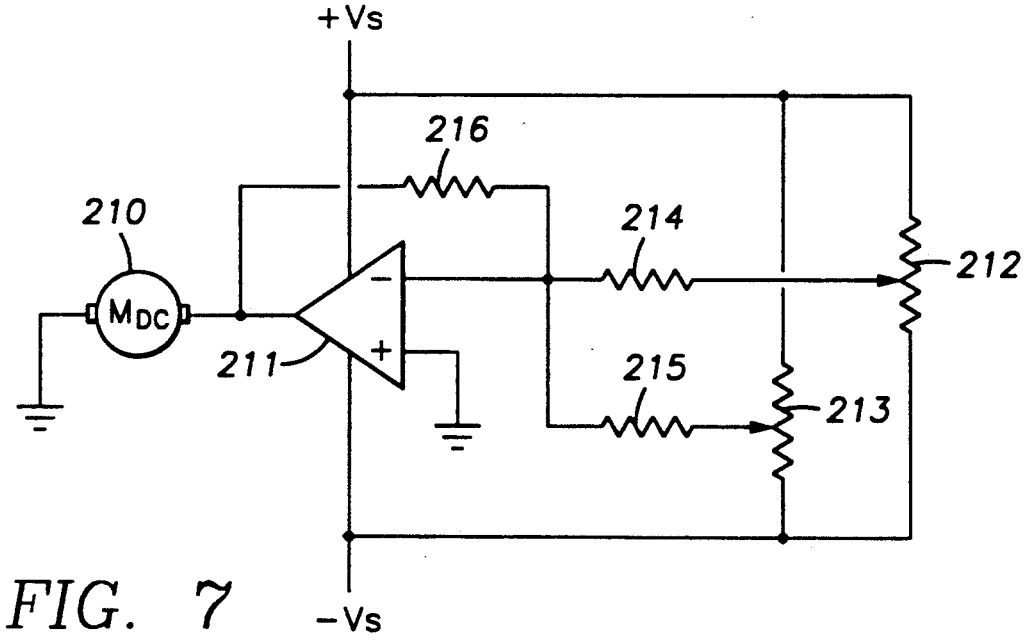
FIG. 7 is a schematic diagram of a servo-amplifier circuit for controlling a DC motor to rotate a flipper in either a clockwise or a counter-clockwise direction.

Turning now to FIG. 7, there is shown a schematic diagram of a known servo circuit for driving a DC motor 210 in both a forward and a reverse direction. A linear amplifier 211 applies a positive voltage to the motor 210 to drive the motor in a clockwise direction, and the linear amplifier 211 applies a negative voltage to the motor 210 to drive the motor 210 in a counter-clockwise direction. The server circuit in FIG. 7 could be used in practicing the present invention, for example, to permit the player (not shown) to adjust the angular position of a flipper (not shown) connected to the motor 210. In this case, the player would adjust a potentiometer 212. Another potentiometer 213 would be connected to the flipper, to sense the angular position of the flipper. The signals from the potentiometers are passed through summing resistors 214 and 215 to a negative input of the amplifier 211. The positive input of the amplifier 211 is grounded. A feedback resistor 216 connects the output of the amplifier 211 to the negative input of the amplifier. Therefore, the amplifier 211 would drive the motor 210 with an error signal derived by a comparison of the sensed angular position of the flipper with the position desired by the player. The potentiometers 212 and 213, for example, could each have a value of 4.7K ohms, the resistors 214 and 215 could each have a value of 10K ohms, and the resistor 216 could have a value of 100K ohms.

Figure 8:
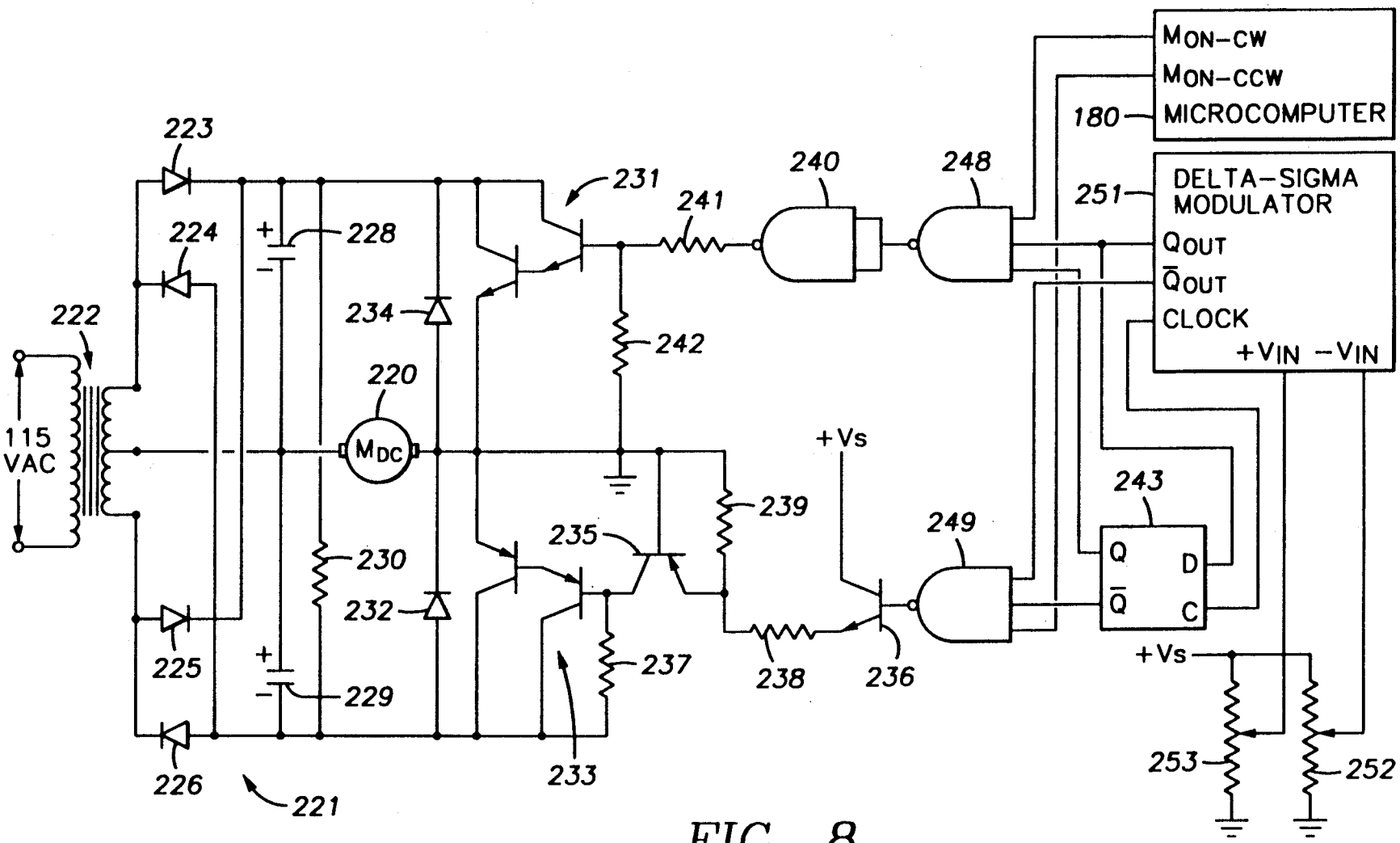
FIG. 8 is an alternative circuit for controlling a DC motor to rotate a flipper in either a clockwise or a counter-clockwise direction.

Turning now to FIG. 8, there is shown a schematic diagram of an alternative circuit for driving a DC motor 220 in both a forward and a reverse direction. This circuit drives the motor 220 with digital pulses. The motor 220 has a separate power supply 221 including a center-tapped transformer 222 for isolating the motor from the 115 volt power lines and for isolating the motor from a power supply (not shown) providing a supply voltage of +Vs (such as 5 volts) to the microcomputer 180, a delta-sigma modulator 251, and the other digital logic components shown in FIG. 8. The power supply 221 further includes bridge rectifier diodes 223, 224, 225, 226, electrolytic capacitors 228, 229, and a resistor 230.

To run the motor 220 in a clockwise direction, a Darlington transistor pair 231 is turned on. A directional diode 232 limits switching transients when the Darlington pair 231 is turned off. In a similar fashion, a second Darlington pair 233 is turned on to run the motor 230 in a counter-clockwise direction, and a directional diode 234 limits switching transients when the Darlington pair 233 is turned off. The second Darlington pair 233 is activated by level-shifting transistors 235 and 236 so that the Darlington pair 233 is turned on and off by a logic signal from ground to the positive supply voltage +Vs. When the level shifting transistor 235 is turned off, then the Darlington pair 233 is turned on by a pull-up resistor 237. The resistor 238, for example, has a value of 1.0 K ohms, the resistor 239 has a value of 2.2K ohms, and the resistor 236 has a value of 10K ohms.

Figure 12:
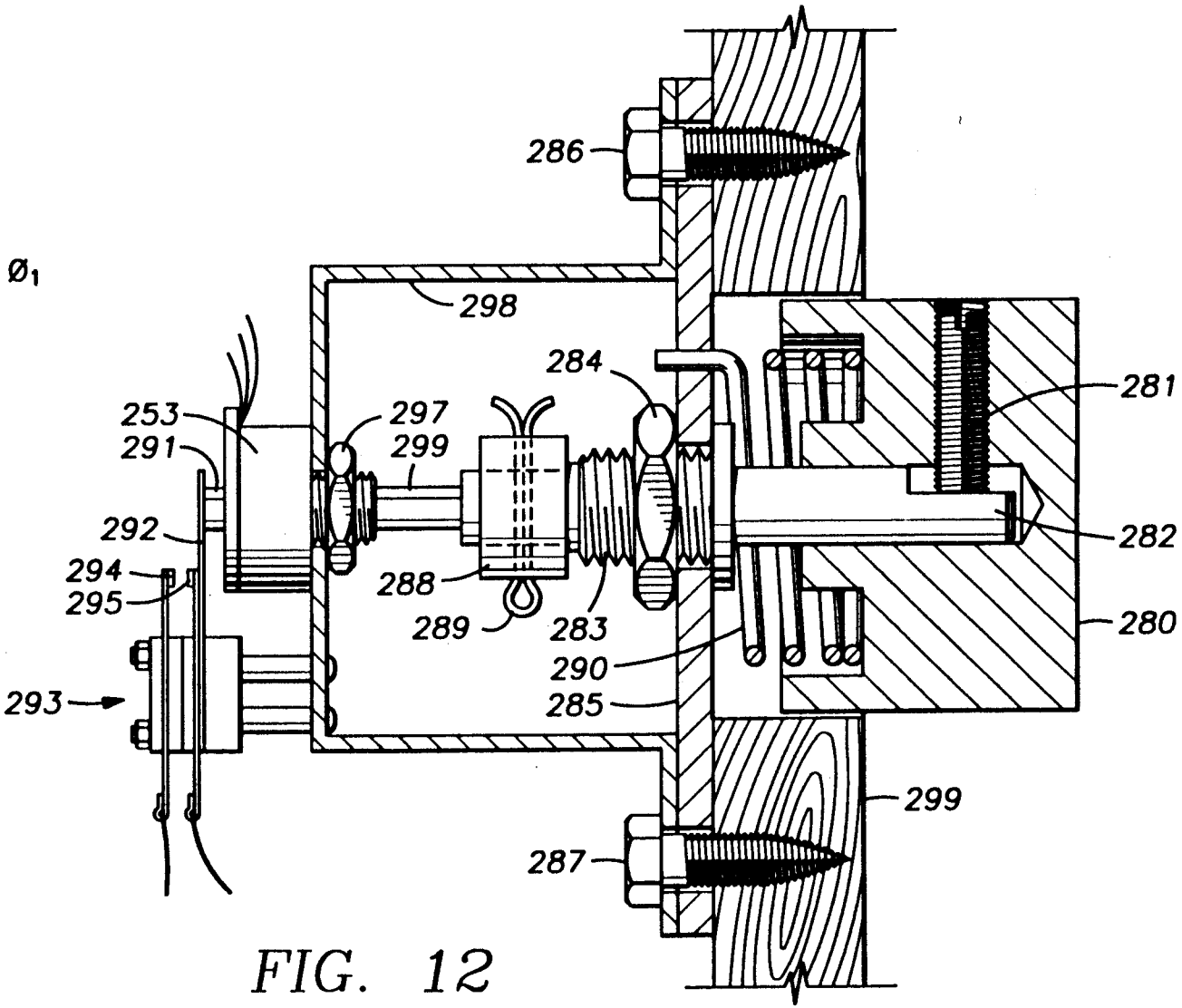
FIG. 12 is a cross-sectional view of a rotary control that could be used in place of a conventional flipper button on the side of the pinball game housing.
Figure 13:
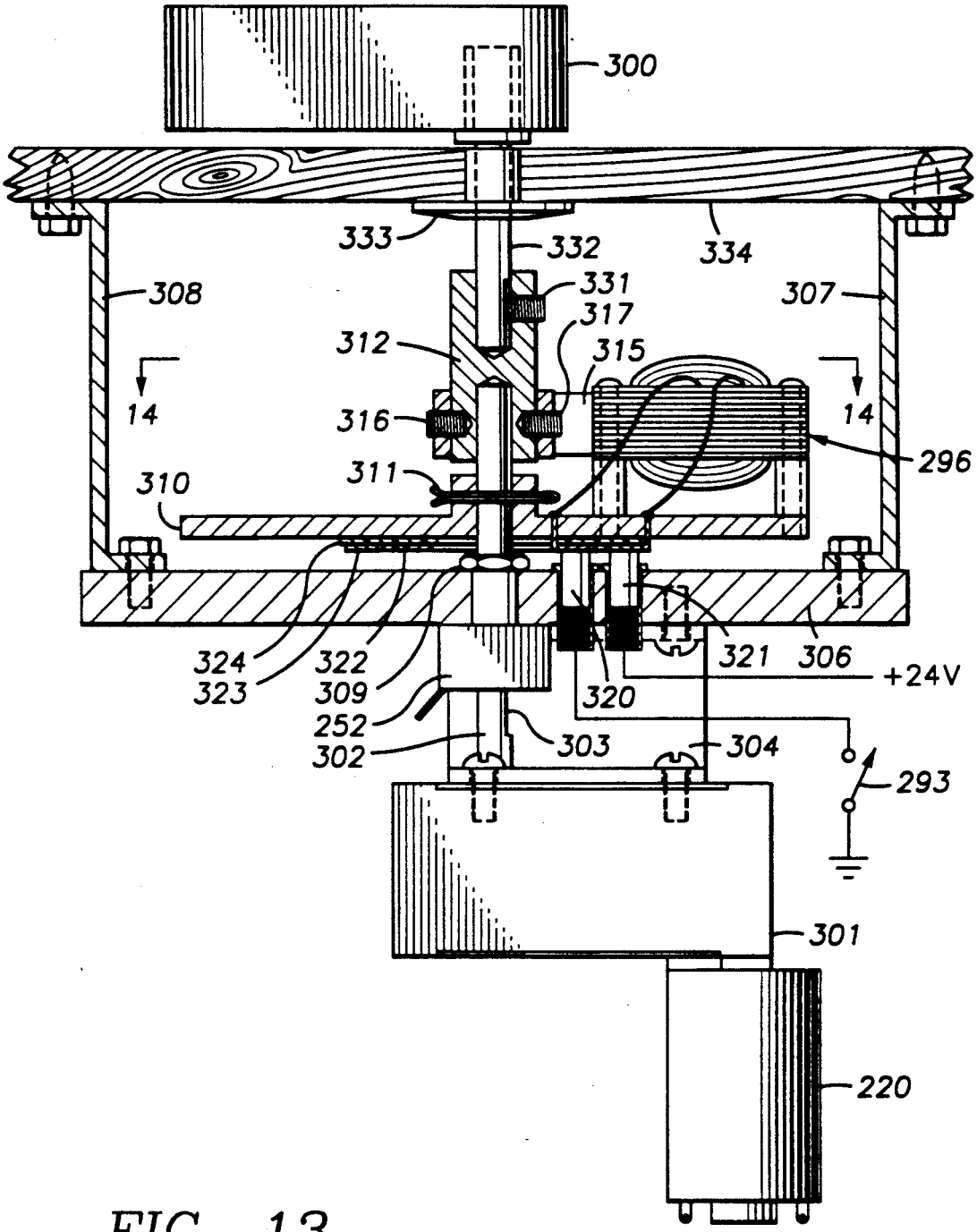
FIG. 13 is an elevation view in partial cross-section of a solenoid mounted between a flipper and a motor for rotating the flipper.
Figure 14:
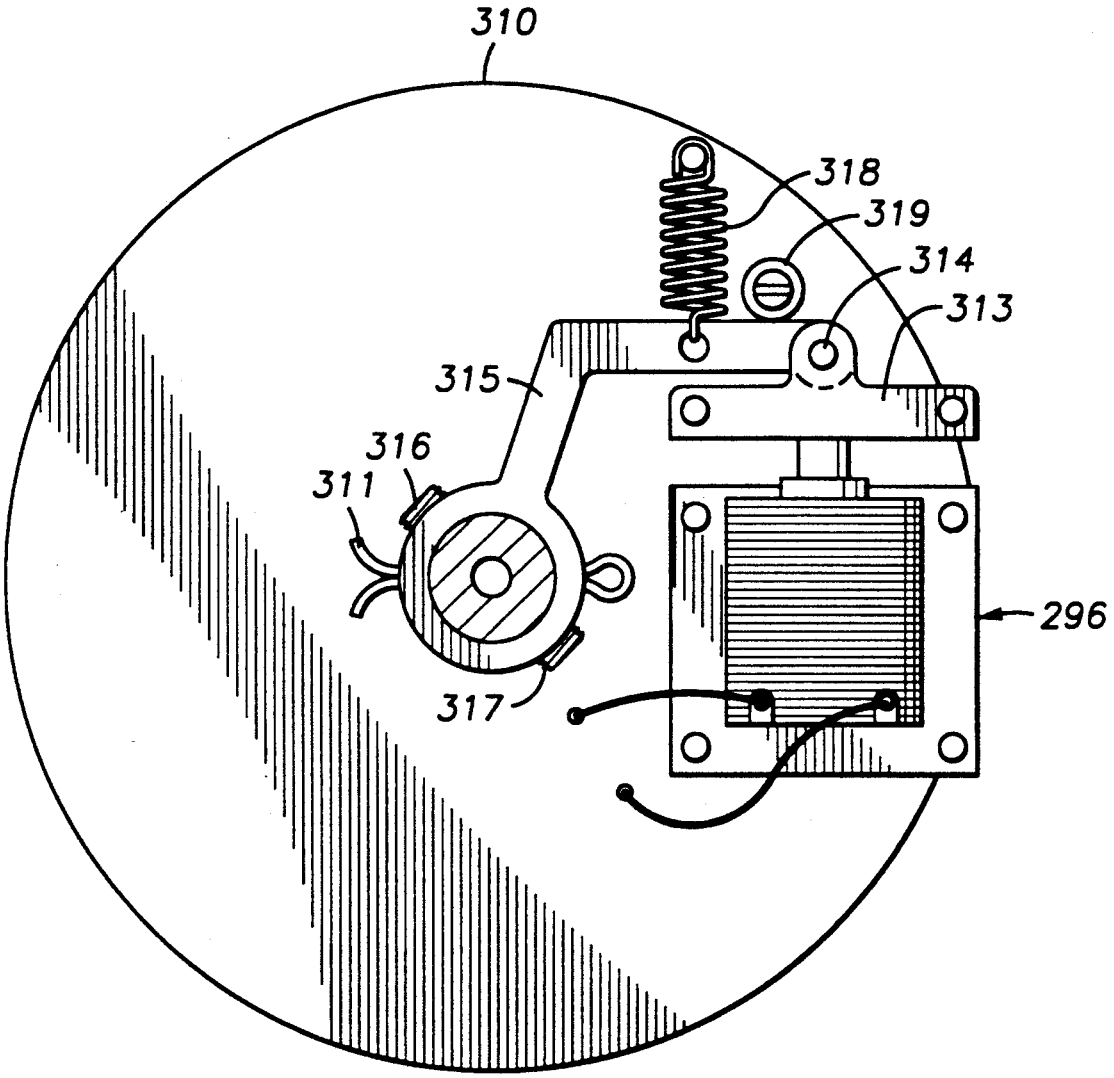
FIG. 14 is a plan view of the solenoid in partial cross-section along line 14—14 in FIG. 13.

The circuit of FIG. 8 is intended to be used with mechanism of FIGS. 13 and 14, and with the control of FIG. 12. The mechanism of FIGS. 13 and 14 has a potentiometer 252 sensing the angular position of a flipper (300 in FIG. 13). The control of FIG. 12 has a potentiometer (253 in FIG. 12) adjusted by the player. So that the player's adjustment of the potentiometer 252 selects the angular position of the flipper (300 in FIG. 13), the potentiometers 252 and 253 provide the negative and the positive control voltages (+Vin, −Vin) to a delta-sigma modulator 251 in FIG. 8. Alternatively, the potentiometer 253 could be independent of the angular position of the flipper 300 and could supply a fixed voltage to the positive input (+Vin) of the delta-sigma modulator 251 so that the player could manipulate the potentiometer 252 to adjust the direction of rotation and angular velocity of the flipper (300 in FIG. 13).

The delta-sigma modulator 251 has a construction as described above with respect to FIG. 6. The digital output (Qout) of the delta-sigma modulator indicates whether the motor 220 should be driven in a clockwise or a counter-clockwise direction.

So that the microcomputer 180 may independently enable and disable both clockwise and counter-clockwise rotation of the flipper (300 in FIG. 13), the microcomputer provides a clockwise enable signal (Mon-cw) to a NAND gate 248, and a counter-clockwise enable signal (Mon-ccw) to a NAND gate 249. The NAND gate 248 passes the true output (Qout) of the delta-sigma modulator 251 to a NAND-gate inverter 240. The output of the NAND-gate inverter 240 is coupled to the Darlington pair 231 through a series resistor 241 and a shunt resistor 242. The resistors 241, 243, for example, each have a value of 3.3K ohms. The NAND gate 249 passes the complement output (Qout complement) directly to the base of the transistor 236. To ensure that both of the Darlington pairs 231, 233 are never conducting simultaneously, the NAND gates 248, 249 are also enabled by respective true and complement outputs of a D-flip-flop 243 asserting a delayed version of the output (Q-out) of the delta-sigma modulator 251. This additional circuitry ensures that there is a delay of at least one cycle of the delta-sigma modulator clock between the time that one of the Darlington pairs 231, 232 turns off and the other one of the Darlington pairs turns on.

Figure 9:
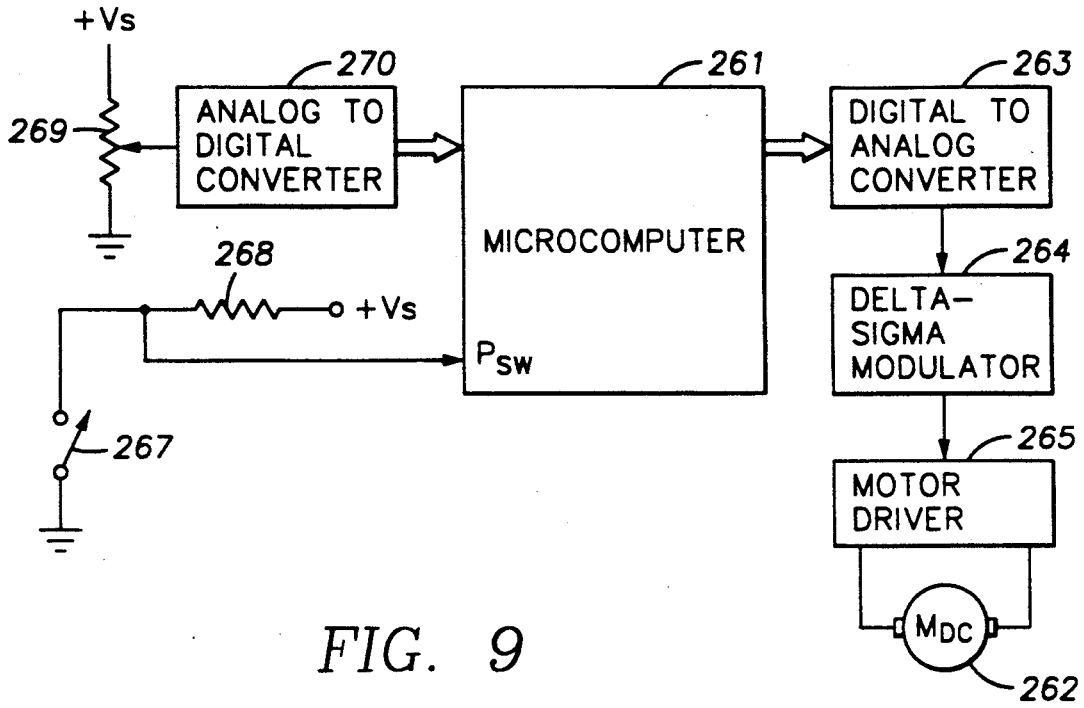
FIG. 9 is a block diagram of an alternative circuit in which a microcomputer selects a control voltage to adjust the angular velocity of the flipper.

Turning now to FIG. 9, there is shown an alternative circuit in which a microcomputer 261 controls a DC motor 262 by a digital velocity command. The digital velocity command, for example, is an eight-bit number. A digital-to-analog converter 263 converts the digital velocity command to an analog control voltage, which is provided to an analog input of a delta-sigma modulator 264. The delta-sigma modulator 264 provides a binary signal to a motor driver 265. For driving the DC motor 262 in only one direction, the delta-sigma modulator 264 and the motor driver 265 may have the construction described above with respect to FIGS. 4 and 6. For driving the DC motor 262 in both a forward and reverse direction, the delta-sigma modulator 264 and the motor driver 265 may have the construction described above with respect to FIG. 8.

The microcomputer 261 may be programmed to compute the digital velocity command in response to a position switch 268, which is connected in series with a pull-up resistor to provide a logic input (Psw) to the microcomputer 261. The microcomputer 261 may also compute the digital velocity command in response to a switch or control manipulated by the player, such as the potentiometer 269. The potentiometer 269 is interfaced to the microcomputer 261 by an analog-to-digital converter 270, so that the microcomputer receives a numeric value selected by the player.

Figure 10:
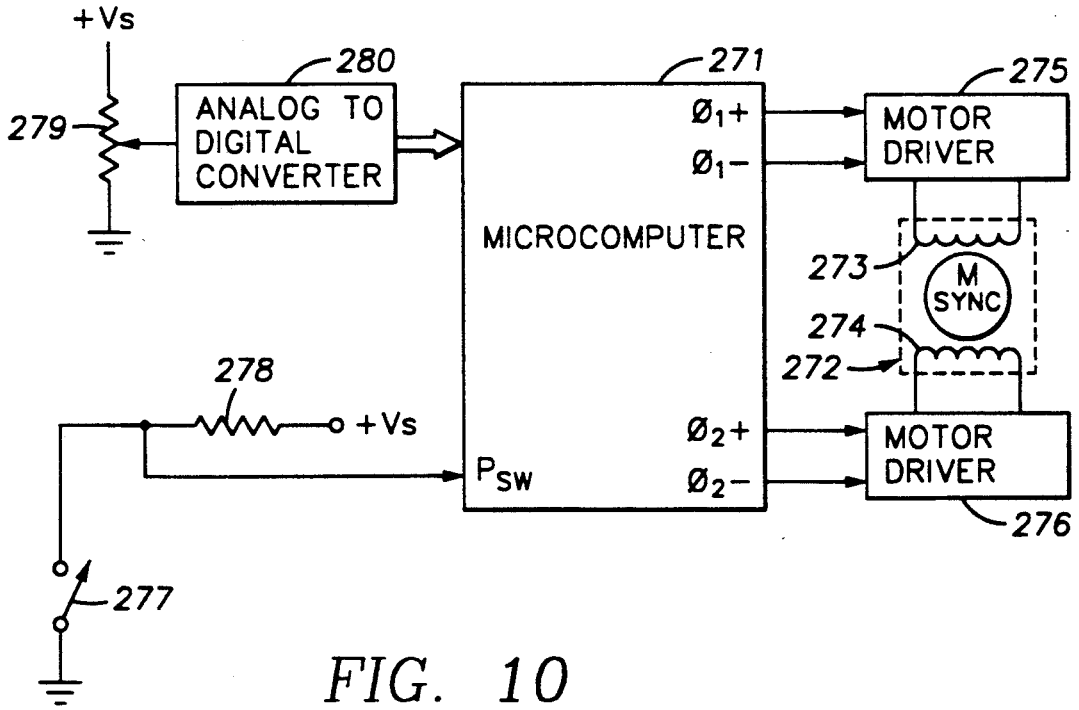
FIG. 10 is a block diagram of an alternative circuit in which a microcomputer controls a synchronous motor to adjust the angular position of the flipper.
Figure 11:
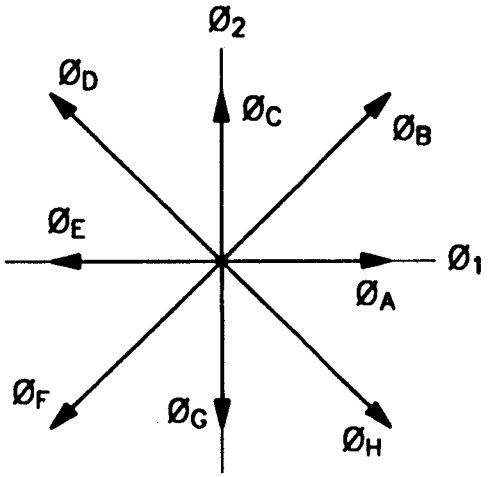
FIG. 11 is a phase diagram illustrating eight different phases generated by the circuit shown in FIG. 9 for stepping the synchronous motor of FIG. 10.

Turning now to FIG. 10, there is shown an alternative circuit in which a microcomputer 271 directly controls the angular position of a synchronous stepper motor generally designated 272. The stepper motor has two quadrature-phase windings 273 and 274. Each winding is driven by a separate motor driver 275, 276 so that the winding has either no current flowing through it, or a current of one polarity flowing through it, or a current of another polarity flowing through it. Therefore each of the motor driver circuits 275, 276 may include components similar to the components 221 to 242 in FIG. 8. Each motor driver circuit is responsive to two binary signals ($\phi+$, $\phi-$) corresponding to whether the NAND gates 248 and 249 in FIG. 7 are enabled, respectively. The four binary signals ($\phi_1+$, $\phi_1-$, $\phi_2+$, $\phi_2-$) define eight different phases, as shown in FIG. 11, in accordance with the following table:

| | MOTOR DRIVER INPUTS | | | |
|---|---|---|---|---|
| POSITION | $\phi_1+$ | $\phi_1-$ | $\phi_2+$ | $\phi_2-$ |
| $\phi_A$ | 1 | 0 | 0 | 0 |
| $\phi_B$ | 1 | 0 | 1 | 0 |
| $\phi_C$ | 0 | 0 | 1 | 0 |
| $\phi_D$ | 0 | 1 | 1 | 0 |
| $\phi_E$ | 0 | 1 | 0 | 0 |
| $\phi_F$ | 0 | 1 | 0 | 1 |
| $\phi_G$ | 0 | 0 | 0 | 1 |
| $\phi_H$ | 1 | 0 | 0 | 1 |

In accordance with a known method for computer control of a stepper motor, the above table is stored in memory of the microcomputer 271 of FIG. 10, and the microcomputer 271 increments or decrements a pointer to the above table to retrieve and output the four binary signals ($\phi_1+$, $\phi_1-$, $\phi_2+$, $\phi_2-$) to step the motor 272 in either a forward or reverse direction. The microcomputer 271, for example, increments or decrements the pointer in response to a position switch 277 working in connection with a pull-up resistor 278, and a potentiometer 279 manipulated by the player (not shown). The potentiometer 279 is interfaced to the microcomputer 271 through an analog-to-digital converter 280.

Turning now to FIG. 12, there is shown a cross-sectional view of a flipper button 280 mounted to a portion of a housing 299 of a pinball game. The flipper button is secured by a set-screw 281 to a shaft 282. The shaft 282 extends through a bushing 283 secured by a nut 284 in a mounting plate 285 fastened by screws 286, 287 to the housing 299. The shaft 282 is retained in the bushing 283 by an annular collar 288 pinned to the shaft by a cotter pin 289. A helical compression spring 290 is mounted between the mounting plate 285 and the flipper button 280, so that the annular collar 288 rests against the bushing 283. However, the player (not shown) may push the flipper button 280 inward into the housing 118, causing an end portion 291 of the shaft 282 to press against a flexible lever 292 of a switch 293 and closing switch contacts 294 and 295. As shown in FIG. 13, the switch 293 is connected in a circuit to a flipper solenoid 296 to intermittently pivot the flipper 300 when the player pushes the flipper button 280 into the housing 299.

Returning now to FIG. 12, the player (not shown) may also rotate the flipper button 280 about its shaft 282 in order to adjust the angular position of the flipper (300 in FIG. 13). The angular position of the flipper button 280 is sensed by a potentiometer 253. The potentiometer 253 is secured by a nut 297 to a bracket 298 that is also secured by the screws 296, 297 to the game housing 118. The shaft 298 has its end portion reduced in diameter and formed with a flat 299 so that the end portion of the shaft 298 may freely slide through the potentiometer 253 in the axial direction of the shaft, yet rotation of the shaft 298 is coupled to the potentiometer. The potentiometer 253, for example, is connected in the motor control circuit of FIG. 8, together with the potentiometer 252 which senses the angular position of the flipper 105, so that the player may rotate the flipper button 280 of FIG. 12 to uniformly adjust the angular position of the flipper 300 of FIG. 13.

Turning now to FIG. 13, it should be apparent that the solenoid 296 is inserted in the mechanical coupling between the motor 220 and the flipper 300. The motor 220 drives a gear box 301 which rotates a shaft 302. The shaft 302 has a flat 303 and passes through the potentiometer 252 which senses the angular position of the flipper 300. The gear box 301 is mounted by a bracket 305 to a plate 306 affixed to the playfield 334 by brackets 307 and 308. The potentiometer 252 is mounted to the plate 306 by a nut 309. The solenoid 296 is mounted to a circular disc 310 that is secured to the shaft 302 by a cotter pin 311. The shaft 301 is received in a coupling 312. The shaft 301, however, may freely rotate with respect to the coupling 312, except that the solenoid 296 provides a linkage between the coupling 312 and the shaft 301. The coupling 312 is secured by a set screw 331 to a shaft 332 of the flipper 300. The shaft 322 of the flipper 300 passes through a bushing 333 mounted in the playfield 334.

As more clearly seen in FIG. 14, the armature 313 of the solenoid 296 is coupled by a pin 314 to a pivot arm 315 secured by set screws 316, 317. When the solenoid 296 is not energized, a return spring 318 holds the pivot arm 315 against a stop 319.

As shown in FIG. 13, the electrical connections to the solenoid 296 are made by spring-loaded carbon brushes 320, 321 which contact respective slip rings 322, 323. The slip rings 322, 323, are copper foil rings formed by etching a printed circuit board 324 which is bonded by epoxy adhesive to the bottom surface of the circular disc 310. The use of the carbon brushes 320, 312 and the slip rings 322, 323 permits the solenoid 296 to be energized while permitting free rotation of the flipper 105 by more than 360 degrees.

For pinball games in which the flipper 300 need only be rotated by less than 360 degrees, then the electrical connections to the solenoid 296 could be made simply by a pair of flexible, multi-conductor wires. The flippers 103, 104 and 105 in the game 100 of FIG. 1, for example, could have their angular positions adjusted by rotation of the flipper buttons 117 and 177' if the flipper buttons were constructed as shown in FIG. 12, and if the flippers 103, 104 and 105 were linked to solenoids and motors in a fashion similar to that shown in FIG. 13. In this case, however, there would be no need to rotate the flippers 103, 104 or 105 by more that about 90 degrees, so that flexible multi-conductor wires could be used for making connections to the flipper solenoids instead of brushes and slip rings.

In view of the above, it should be apparent that the present invention provides a rotating flipper that can be controlled internally through software of the microcomputer that keeps track of game sequences and the player's score, or externally via a switch or control manipulated by the player. Various kinds of switches or controls could be used as an interface with the player, such as foot pedals, knobs, push-buttons, keyboards, joysticks or proximity sensors.

Preferably, the angular position of the flipper is sensed by a switch or rotational sensor such as a potentiometer. The use of a position switch permits a microcomputer to rotate the flipper to a predefined angular position. The microcomputer could also drive the motor rotating the flipper for a selected length of time after the position switch detects the predefined position, in order to rotate the flipper to other selected angular positions. From a rest position, the microcomputer could pulse the motor for a selected length of time in order to rotate the flipper over an arc of a selected number of degrees. The microcomputer could also count transitions in the logic signal from the position switch to count revolutions of the flipper.

The rotating flipper of the present invention can be used offensively or defensively in game rule strategy, depending on the geometric layout or configuration of the playfield. The rotating flipper can be used to define a "timing shot" wherein the flipper is rotated continuously to intermittently define a path for the ball to a restricted region of the playfield, such as a target or channel. The player, for example, must shoot a ball past the rotating flipper to reach a predefined region of the playfield such as a target or channel. The rotating flipper could also be used to deflect a ball into a predefined region, such as another target or another area of play. In either case, the player must coordinate the timing of the shot with the angular position of the flipper. Player interest can be enhanced by activating, de-activating, or otherwise changing, the rate or direction of rotation of the flipper depending on game sequences in response to the position or duration of travel of the ball over the playfield, the player's score, or input from the player through a switch or control manipulated by the player.

What is claimed is:

1. A pinball machine comprising:

a playfield supporting a rolling ball;

a first flipper that is activated by a player of said pinball machine;

a second flipper mounted on said playfield for rotation about an axis generally perpendicular to said playfield and having a surface for striking and deflecting said ball; and a motor mounted beneath said playfield and coupled to said second flipper for continuously rotating said second flipper by more than 360 degrees;

wherein rotation of said second flipper by said motor intermittently defines a predetermined path for said ball to reach a predefined region of said playfield and deflects said ball from said predefined region of said playfield unless passage of said ball over said predetermined path is synchronized to said rotation of said second flipper by said motor; and wherein said predefined path originates from said first flipper that is activated by said player of said pinball machine.

2. A pinball machine comprising:

a playfield supporting a rolling ball;

a flipper mounted on said playfield for rotation about an axis generally perpendicular to said playfield and having a surface for striking and deflecting said ball; and a motor mounted beneath said playfield and coupled to said flipper for continuously rotating said flipper by more than 360 degrees;

wherein rotation of said flipper by said motor intermittently defines a predetermined path for said ball to reach a predefined region of said playfield and deflects said ball from said predefined region of said playfield unless passage of said ball over said predetermined path is synchronized to said rotation of said flipper by said motor; and further including a speed control coupled to said motor for manipulation by a player of said pinball machine for speed adjustment of said motor.

3. A pinball machine comprising:

a playfield supporting a rolling ball;

a flipper mounted on said playfield for rotation about an axis generally perpendicular to said playfield and having a surface for striking and deflecting said ball; and a motor mounted beneath said playfield and coupled to said flipper for continuously rotating said flipper by more than 360 degrees;

wherein rotation of said flipper by said motor intermittently defines a predetermined path for said ball to reach a predefined region of said playfield and deflects said ball from said predefined region of said playfield unless passage of said ball over said predetermined path is synchronized to said rotation of said flipper by said motor;

further comprising a microcomputer coupled to said motor to turn said motor on and off; and further comprising an angular position sensor for sensing angular position of said flipper, said angular position sensor being electrically coupled to said microcomputer, and said microcomputer being programmed to turn said motor on and off in response to said angular position of said flipper sensed by said angular position sensor.

4. A pinball machine comprising:

a playfield supporting a rolling ball;

a flipper mounted on said playfield for rotation about an axis generally perpendicular to said playfield and having a surface for striking and deflecting said ball; and a motor coupled to said flipper for rotating said flipper by more than 360 degrees;

wherein rotation of said flipper by said motor intermittently defines a predetermined path for said ball to reach a predefined region of said playfield and deflects said ball from said predefined region of said playfield unless passage of said ball over said predetermined path is synchronized to said rotation of said flipper by said motor;

wherein said predefined path originates from another flipper that is activated by an operator of said pinball machine; and wherein said pinball machine further includes a speed control coupled to said motor for manipulation by a player of said pinball machine for speed adjustment of said motor.

5. The pinball machine as claimed in claim 4, wherein said predetermined path over said playfield includes deflection of said ball by said flipper such that said ball must be deflected by said flipper to reach said predefined region along said predefined path over said playfield.

6. The pinball machine as claimed in claim 4, further comprising a microcomputer coupled to said motor to turn said motor on and off; and further comprising an angular position sensor for sensing angular position of said flipper;

wherein said angular position sensor is electrically coupled to said microcomputer, and said microcomputer is programmed to turn said motor on and off in response to said angular position of said flipper sensed by said angular position sensor.

7. The pinball machine as claimed in claim 4, further comprising a microcomputer coupled to said motor to turn said motor on and off; and further comprising a switch responsive to movement of said ball over said playfield;

wherein said switch is electrically connected to said microcomputer, said microcomputer is programmed to define a game sequence responsive to said switch, and said game sequence includes programming for said microcomputer to turn said motor on and off.

8. A pinball machine comprising:

a playfield supporting a rolling ball;

a flipper mounted on said playfield for rotation about an axis generally perpendicular to said playfield and having a surface for striking and deflecting said ball; and a motor coupled to said flipper for rotating said flipper; and a control coupled to said motor for manipulation by a player of said pinball machine for adjustment of rotation of said flipper by said motor;

wherein said control adjusts angular velocity of rotation of said flipper by said motor.

9. The pinball machine as claimed in claim 8, wherein said angular velocity of rotation of said flipper adjusted by said control includes angular velocity of rotation in both a clockwise direction and a counter-clockwise direction.

10. A pinball machine comprising:

a playfield supporting a rolling ball;

a flipper mounted on said playfield for rotation about an axis generally perpendicular to said playfield and having a surface for striking and deflecting said ball; and an electric motor coupled to said flipper for rotating said flipper; and a control coupled to said electric motor for manipulation by a player of said pinball machine for adjustment of rotation of said flipper by said electric motor;

further comprising a solenoid coupled between said electric motor and said flipper for pivoting said flipper by said solenoid independently of rotation of said flipper by said electric motor.

11. The pinball machine as claimed in claim 10, further comprising a switch connecting to said solenoid in an electrical circuit for actuation of said solenoid by a player of said pinball machine.

12. A pinball machine comprising:

a playfield supporting a rolling ball;

a flipper mounted on said playfield for rotation about an axis generally perpendicular to said playfield and having a surface for striking and deflecting said ball; and a motor coupled to said flipper for rotating said flipper; and a control coupled to said motor for manipulation by a player of said pinball machine for adjustment of rotation of said flipper by said motor;

further comprising a microcomputer coupled to said motor for control of rotation of said flipper by said motor.

13. A pinball machine comprising:

a playfield supporting a rolling ball;

a flipper mounted on said playfield for rotation about an axis generally perpendicular to said playfield and having a surface for striking and deflecting said ball; and a motor coupled to said flipper for rotating said flipper; and a control coupled to said motor for manipulation by a player of said pinball machine for adjustment of rotation of said flipper by said motor;

further including an angular position sensor sensing angular position of said flipper and coupled to said motor to control rotation of said flipper by said motor.

14. A pinball machine comprising:

a playfield supporting a rolling ball;

a flipper mounted on said playfield for rotation about an axis generally perpendicular to said playfield and having a surface for striking and deflecting said ball;

a motor coupled to said flipper for rotating said flipper; and an angular position sensor for sensing angular position of said flipper, said angular position sensor being electrically coupled to said motor to control said rotation of said flipper by said motor.

15. The pinball machine as claimed in claim 14, further comprising a microcomputer electrically coupling said angular position sensor to said motor to control said rotation of said flipper by said motor.

16. A pinball machine comprising:

a playfield supporting a rolling ball;

a flipper mounted on said playfield for rotation about an axis generally perpendicular to said playfield and having a surface for striking and deflecting said ball; and a motor coupled to said flipper for rotating said flipper; and a microcomputer responsive to movement of said ball over said playfield and electrically coupled to said motor to control said rotation of said flipper by said motor in accordance with a predefined control sequence programmed in said microcomputer.

17. A pinball machine comprising:

a playfield supporting a rolling ball;

a flipper mounted on said playfield for rotation about an axis generally perpendicular to said playfield and having a surface for striking and deflecting said ball;

an electric motor mounted beneath said playfield and coupled to said flipper for rotating said flipper; and a solenoid coupled between said electric motor and said flipper for pivoting said flipper by said solenoid independently of rotation of said flipper by said electric motor.

18. A method of operation of a pinball machine having a playfield supporting a rolling ball, a flipper mounted on said playfield for rotation about an axis generally perpendicular to said playfield and having a surface for striking and deflecting said ball, and a motor coupled to said flipper for rotating said flipper by more than 360 degrees, said method comprising the steps of:

a) activating said motor to rotate said flipper so that rotation of said flipper intermittently defines a predetermined path for said ball to reach a predefined region of said playfield and deflects said ball from said predefined region of said playfield unless passage of said ball over said predetermined path is synchronized to said rotation of said flipper by said motor;

b) receiving input from a player of said pinball machine and using said input to control synchronization of said passage of said ball over said predetermined path to said rotation of said flipper by said motor; and c) awarding points to said player when said ball travels along said predetermined path to reach said predefined region of said playfield.

19. The method as claimed in claim 18, wherein said predetermined path over said playfield includes deflection of said ball by said flipper such that said ball must be deflected by said flipper to reach said predefined region along said predefined path over said playfield.

20. The method as claimed in claim 18, wherein said input from said player is used to control synchronization of said passage of said ball over said predetermined path to said rotation of said flipper by said motor by adjusting velocity of said rotation of said flipper by said motor.

21. The method as claimed in claim 18, which further includes operating a microcomputer to control rotation of said flipper by said motor.

22. The method as claimed in claim 21, wherein said microcomputer controls said motor in response to movement of said ball over said playfield.

23. The method as claimed in claim 21, wherein said microcomputer controls said motor in response to sensing angular position of said flipper.

* * * * *